US006722090B2

(12) United States Patent
Gerhaher

(10) Patent No.: US 6,722,090 B2
(45) Date of Patent: Apr. 20, 2004

(54) EXTRUSION MOLDED FACADE PANEL

(75) Inventor: Max Gerhaher, Landau/Isar (DE)

(73) Assignee: Franz Gerhaher, Straubing (DE); part interest ( * ) Notice: Subject to any disclaimer, the term of this patent is extended or adjusted under 35 U.S.C. 154(b) by 0 days.

(21) Appl. No.: 09/872,999

(22) Filed: Jun. 1, 2001

(65) Prior Publication Data

US 2002/0014049 A1 Feb. 7, 2002

(30) Foreign Application Priority Data

Jun. 2, 2000 (DE) ..... 100 27 502

(51) Int. Cl.[7] ..... E04F 13/08

(52) U.S. Cl. ..... 52/235; 52/762; 52/302.3; 52/778; 52/779; 52/606

(58) Field of Search ..... 52/235, 302.1, 52/302.3, 302.4, 762, 764, 778, 779, 591.4, 592.1, 606, 609, 384, 506.03

(56) References Cited

U.S. PATENT DOCUMENTS

| | | | | | |
|---|---|---|---|---|---|
| 525,097 | A | * | 8/1894 | Flint | 52/779 |
| 1,509,424 | A | * | 9/1924 | Garrard | 52/779 |
| 1,601,411 | A | * | 9/1926 | Parmley | 405/135 |
| 1,807,138 | A | * | 5/1931 | Spelshouse | 52/437 |
| 1,913,266 | A | * | 6/1933 | Rose et al. | 52/435 |
| 3,286,418 | A | * | 11/1966 | Radford | 52/223.6 |
| 5,644,887 | A | * | 7/1997 | Gerhaher et al. | 52/606 |
| 5,860,257 | A | * | 1/1999 | Gerhaher et al. | 52/235 |
| 6,205,731 | B1 | * | 3/2001 | Gerhaher | 52/235 |
| 6,289,644 | B1 | * | 9/2001 | Gerhaher | 52/235 |
| 6,421,974 | B1 | * | 7/2002 | Whitehouse et al. | 52/510 |

FOREIGN PATENT DOCUMENTS

| | | | | | |
|---|---|---|---|---|---|
| AT | 181414 | | * | 3/1955 | 52/606 |
| AT | 344563 | | | 11/1977 | |
| DE | 2013857 | | * | 10/1971 | 52/235 |
| DE | 3110606 | | | 9/1982 | |
| DE | 3448392 | | | 7/1985 | |
| DE | 3641747 | A1 | * | 6/1988 | E04F/13/14 |
| DE | 0540036 | | | 5/1993 | |
| DE | 4325873 | | | 2/1995 | |
| DE | 4420890 | | | 1/1996 | |
| DE | 19718716 | | | 11/1998 | |
| DE | 19756718 | | | 7/1999 | |
| EP | 0060542 | A1 | * | 3/1982 | E04F/13/14 |

* cited by examiner

*Primary Examiner*—Brian E. Glessner
(74) *Attorney, Agent, or Firm*—Dilworth & Barrese LLP

(57) ABSTRACT

An extrusion moulded, preferably ceramic, facade panel (11) for a curtained, back-ventilated facade construction consists of a front and a rear panel formwork (12, 13) which are connected to one another by webs (14) and are provided with elongate apertures (15) which are arranged parallel to the webs (14) between the same and which is provided with a top rabbet (16) at the upper end of the facade panel (11). To allow the facade panel to be manufactured at a more favorable cost and with more precise dimensions, the height (17) of the top rabbet (16) formed by the rear panel formwork (13) is smaller than or equal to the height of the joint (19) visible from the front side (18) of the facade.

16 Claims, 3 Drawing Sheets

EXTRUSION MOLDED FACADE PANEL

BACKGROUND OF THE INVENTION

The invention relates to an extrusion molded, preferably ceramic, facade panel for the curtained, back-ventilated mounting on a sub-structure, wherein the facade panel (11) consists of a front and rear panel framework (12,13) which are connected to one another by webs (14) and are provided with elongate apertures (15) which are arranged parallel to the web (14) between the same and which is provided with a top rabbet (16) at the upper end of the facade panel (11).

Extrusion moulded ceramic facade panels in upright format are known from DE 43 25 873 which are formed by a front and a rear panel formwork, which are connected to one another by vertically extending webs and are provided with elongate apertures which are arranged between the webs. At the top-side edge of these facade panels, the protruding rear panel formwork forms a top rabbet which is higher than the height of the horizontal joint visible from the front side which is formed by two facade panels arranged above one another. At the bottom-side edge of the facade panels, the protruding front panel formwork forms a bottom rabbet which is higher than the height of the horizontal joint between facade panels arranged above one another visible from the rear side of the facade. The facade has a visually closed appearance from the outside (and also from the inside) due to the top and bottom rabbets gripping behind one another. Furthermore, an optimum water guiding of the facade water running off at the front side of the facade results, as does the possibility to attach the panel holders in a largely covered manner. The disadvantage of this construction can be found in the fact that the top and bottom rabbets extend transversely to the direction of extrusion moulding so that these cannot be simultaneously extruded in the extrusion moulding process. The only possibility that therefore remains is to apply the top and bottom rabbets to the facade panels in a plastic, dried or burnt state. In the manufacture of the top or bottom rabbets in the plastic state, very coarse, unacceptable tolerances result in the burnt facade panel due to the unavoidable ceramic shrinkage differences. In the manufacture in the dried state, e.g. by cutting, intolerably large edge chips occur. In the burnt state, there is the possibility of cutting, which is too expensive due to the great volume removed by cutting. Another possibility is the manufacture of the top and bottom rabbets by a plurality of cuts using a circular saw. The panel is cut to length in the first cut at each panel end; these cuts are not complicated and can be carried out at high precision simultaneously at the opposite panel ends, with as a rule the facade panels being pushed through under the two laterally arranged circular saws in a lying, transverse manner. Then, in a further workstep, one cut each is made from both sides at a right angle to the first cut—i.e. in the direction of the aperture. These cuts are carried out in the lying panel by two saw blades arranged at both sides with a cut depth which corresponds to the height of the top or bottom rabbet. These cuts can also be made simultaneously at high precision. The respective third cut at each end of the facade panel must, however, be made from different directions, at the top end from the front side of the panel and at the bottom end from the rear side of the panel. A pair of forces results from the opposing actions of the saws which exerts a torque on the lying panels so that it is very difficult to fix the panels on the conveying device with the required precision. The consequence of this is a high reject rate by the exceeding of the permitted narrow dimensional tolerances. Ultimately, this can only be prevented by an extremely precise and stable fixing of the panels to the machine or by two additional, individual worksteps (cuts) under otherwise identical conditions. The manufacturing costs of top and bottom rabbets transversely to the direction of extrusion moulding by respectively three cuts at the burnt panels are additionally substantially increased by these complications of the asymmetrical exertion of force so that the upright version of the extrusion moulded faces with a vertical aperture arrangement thereby becomes considerably less economical than the oblong version with horizontal apertures and the top and bottom rabbets moulded on in the same workstep.

SUMMARY OF THE DRAWING

It is therefore the object of the invention to describe an extrusion moulded facade panel and a method for its manufacture whose rabbets are arranged transversely to their apertures, which meets the architectonic technical and physical construction requirements, but which can be manufactured at lower cost and with more precise dimensions.

This object is solved in accordance with this invention by the characteristics of the height (17) of the top rabbet (16) formed by the rear panel framework (13) being smaller than or equal to the height of the joint (19) visible from the facade front side (18). The advantage of this embodiment consists of the height of the top rabbet formed by the rear panel formwork being lower than the height of the joint visible from the front of the facade. A top rabbet of such a low height can be carried out by the use of a double saw blade. The outer—seen from the facade panel—saw blade has an engagement depth which is greater than the panel thickness; the inner saw blade extends only approximately to half the panel thickness, i.e., up to the inner surface of the rear panel formwork. In this way, a top rabbet remains with a height which corresponds to the thickness of the inner saw blade. The bottom end of the facade panel is simultaneously cut to shape by a further saw blade whose engagement depth is greater than the panel thickness. Due to the simultaneous engagement of both saws, a practical balance of the cutting forces acting on the facade panels results so that a precise cut is achieved at both ends. The balance of the cutting forces can also be increased by the use of a reinforced saw blade at the bottom of the panel. The state in the manufacturing process is shown in FIG. 1, with the upper side of the lying panel being arranged at the front side of the facade in the mounted state of FIG. 2.

Figure 3:
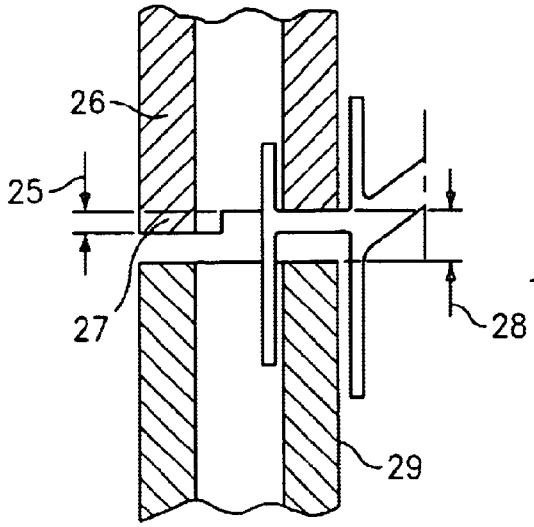

In another preferred embodiment in accordance with FIG. 3, the facade panel has a bottom rabbet of lower height which is formed by the front panel formwork. The advantage of this embodiment is in the fact that the facade can be mounted with a particularly low horizontal joint visible from the front side.

Figure 4:
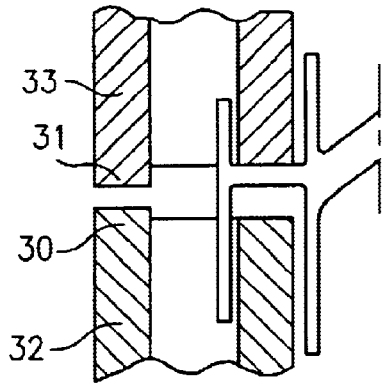

In another embodiment of the invention in accordance with FIG. 4, the facade panels are formed with top and bottom rabbets (30, 31) at the front panel formwork (32, 33). This has the advantage that the bottom rabbet is formed as a drop rabbet and thereby the directing of the water to the rear of the facade is avoided by adhesion to the lower edge. At the same time, the formation of very narrow joints at the front side is possible if this is wanted for architectonic reasons.

Figure 5:
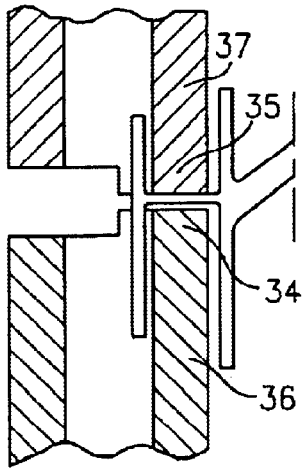

In another aspect of the invention in accordance with FIG. 5, the top and bottom rabbets are formed by the rear panel formwork. This has the advantage that wide horizontal joints visible from the front side can be formed, but that the actual open joint gap can be kept narrow.

The aspect of the facade panel in accordance with the invention is particularly advantageous in that the height of the joint visible from the front side is relatively small in relation to the thickness of the front panel formwork; at least smaller than twice the thickness of the front panel formwork. In this way, the view into the elongate apertures of the facade panels is obstructed.

In addition, in a further advantageous aspect of the invention, the thickness of the front panel formwork is relatively small in relation to the depth of the elongate apertures; at least smaller than one and a half times the depth of the elongate apertures. In this way, inherent weight is saved.

In another advantageous embodiment of the facade panel in accordance with the invention, the top and bottom rabbets are formed by cuts inclined slightly obliquely towards the front side of the panel, with the height of the top or bottom rabbet formed by the oblique cut being smaller than the height of the horizontal joint visible from the front side of the facade. The advantage of this embodiment can be found in the fact that no double saw blade is needed.

BRIEF DESCRIPTION OF THE DRAWINGS

Figure 1:
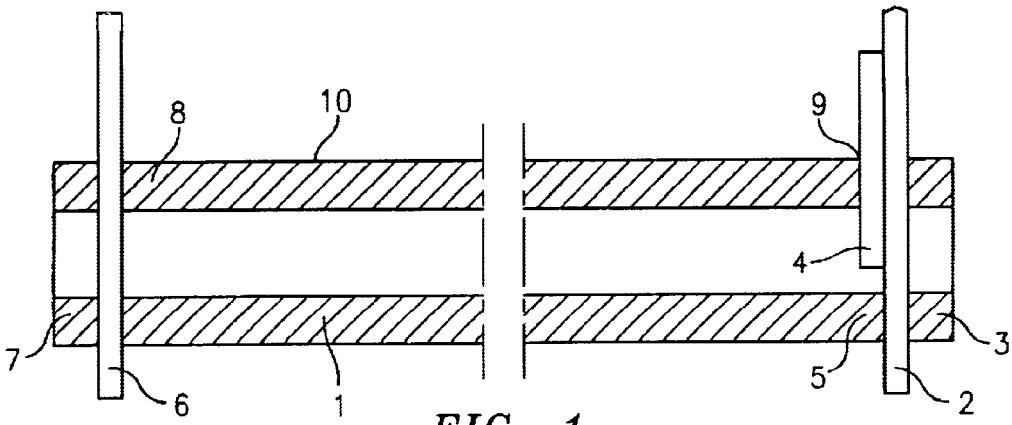
Figure 2:
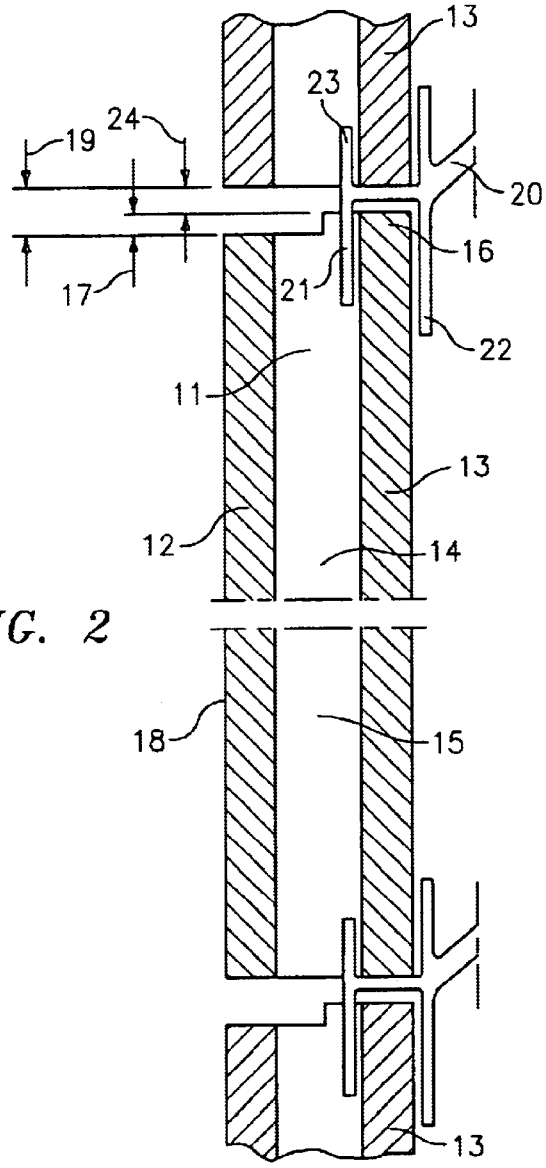
Figure 6:
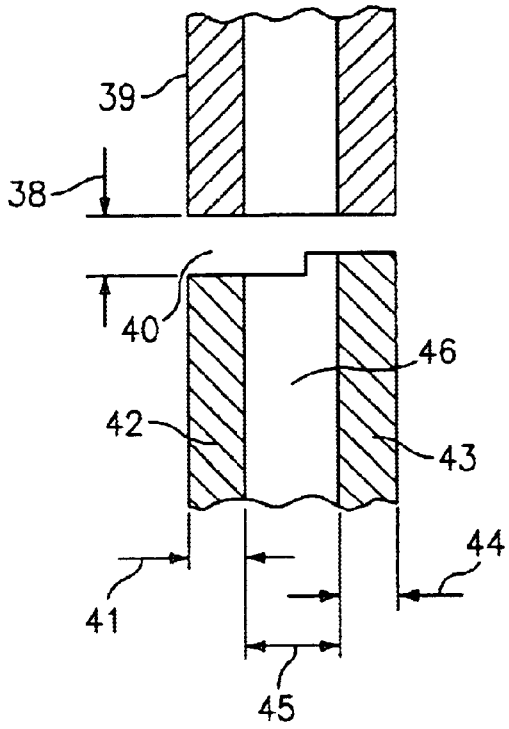

The invention is explained by way of example in the following description with reference to the drawings, in which are shown:

FIG. 1 a facade panel in cross-section during the manufacture of the top rabbet and the cutting off of the bottom end by circular saws;

FIG. 2 a vertical section through three facade panels in the mounted state;

FIG. 3 a vertical section through two facade panels in the mounted state;

FIG. 4 a further vertical section;

FIG. 5 a further vertical section;

FIG. 6 a further vertical section; and

Figure 7:
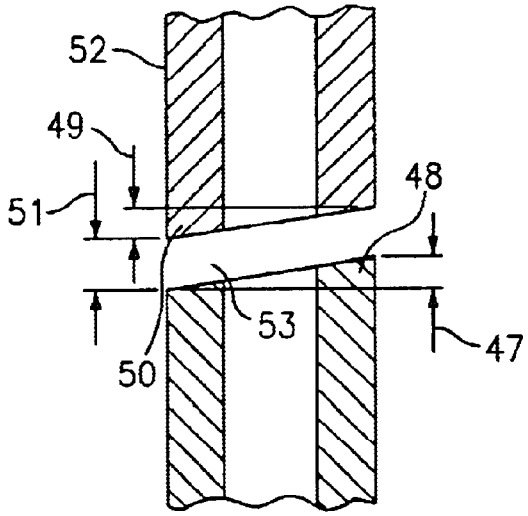

FIG. 7 a further vertical section.

DESCRIPTION OF THE PREFERRED EMBODIMENTS

In the vertical section, shown in FIG. 1, through the facade panel 1 lying during the manufacturing process, the large circular saw blade 2 cuts off the superfluous waste 3 at the right hand side, the top end of the panel, while the smaller circular saw blade 4 arranged on the inside only engages the panel in part so that a lower top rabbet 5 remains. On the left hand side, a somewhat thicker circular saw blade 6 cuts off the waste 7 at the bottom side. The saw blades 2 and 4 and the saw blade 6 exert approximately identical cutting forces on the facade panel 1 so that no transposition of the same occurs during the cut and so that thereby the cut edges 8 and 9 can be made with high precision at the upper side 10 of the facade panel 1 and also the top rabbet 5.

In the vertical section, shown in FIG. 2, through three facade panels, the top rabbet 16 is formed at the top end by the protruding rear panel formwork 13 and has a height 17 lower than the height of the joint 19. The lower flanges 21 of the panel holders 20 engage into the elongate apertures 15 between the webs 14 from above and support the facade panel from the rear side with the rear lower flanges 22. The flanges 23 engage from below into the elongate apertures of the panel arranged above them. While the facade water flowing off at the front side 18 of the facade, can penetrate in part the horizontal joints with the height 19, it is immediately led off to the bottom through the elongate apertures 15. Such a good water guidance is ensured by this drainage that the top rabbet 16 with its low height 17 is fully sufficient. A sufficient ventilation and venting of the curtained facade construction is ensured by the joint height 24 remaining over the top rabbet (as the difference between the joint height 19 after the deduction of the top rabbet height 17).

In the vertical section shown in FIG. 3, the front panel formwork 26 forms a bottom rabbet 27 whose height 25 is smaller than the height 28 of the joint visible from the rear side 29. A particularly low horizontal joint visible from the front results from this arrangement. The advantages of the manufacture described above are the same. The visual view into the depth of the facade joint is even lower; the water guidance is, however, somewhat worse than that of the embodiment in accordance with FIG. 2 due to the lack of the top rabbet.

In FIG. 4, top and bottom rabbets 30 and 31 are formed by the front panel formwork 32 and 33 so that a very tight joint results at the front side of the facade.

In FIG. 5, top and bottom rabbets 34 and 35 are formed by the rear panel framework 36, 37; this allows the formation of a very wide joint at the front side of the facade.

It is shown in FIG. 6 that the joint height 38 is smaller than twice the thickness 41 of the front panel framework 42 and that this is smaller than one and a half times the aperture depth 45.

It is shown in FIG. 7 that a lower top rabbet 48 and/or a lower bottom rabbet 50, whose height is smaller than the height 51 of the visible joint 53, can also be formed by a slight oblique cut.

What is claimed is:

1. A curtained, back-ventilated facade construction comprising a plurality of extrusion molded facade panels (1), the panels (1) arranged as front and rear panel frameworks (12,13) which are connected to one another by webs (14) and provided with elongate apertures (15) substantially parallel to the webs (14) between the same, said facade construction provided with a top rabbet (16) at an upper end of a respective facade panel (1), wherein height (17) of the top rabbet (16) formed by an extension of the rear panel framework (13) is smaller than or equal to height of a joint (19) visible from a front side (18) of the facade construction and defined between adjacent front panels (1), and the top rabbet (16) extends transversely to the elongate apertures.

2. A facade construction in accordance with claim 1, wherein height (38) of the joint (40) visible from the front side (39) of the facade construction is smaller than or equal to twice thickness (41,44) of the front or rear panel frameworks (42,43).

3. A facade construction in accordance with claim 2, wherein the thickness (41,44) of the front or rear panel frameworks (42,43) is smaller than or equal to one and a half times depth (45) of the apertures (46) between the front and rear panel frameworks (42,43).

4. A facade construction in accordance with claim 1, wherein the height (47) of the top rabbet (48) formed by an oblique cut and height (49) of bottom rabbet (50) formed by an oblique cut is smaller than or equal to the height (51) of the joint (53) visible from the front side (52) of the facade construction.

5. A facade construction in accordance with claim 1, structured and arranged such that water flowing off the front side (18) of the facade construction penetrates, in part, the joint (19) and is immediately directed to a bottom of the construction through the elongate apertures (15).

6. A facade construction in accordance with claim 1, wherein said top rabbet (16) extends transversely to an extrusion direction of the panels (1).

7. A facade construction in accordance with claim 1, wherein the facade panels are ceramic.

8. A curtained, back-ventilated facade construction comprising a plurality of extrusion molded facade panels (1), the panels (1) arranged as front and rear panel frameworks (12,13) which are connected to one another by webs (14) and provided with elongate apertures (15) substantially parallel to the web (14) between the same, said facade construction provided with a bottom rabbet (16) at a lower end of a respective facade panel (1), wherein height (25) of the bottom rabbet (27) formed by an extension of the front panel framework (26) is smaller than or equal to height of a joint (28) visible from a rear side (29) of the facade construction and defined between adjacent rear panels (1).

9. A facade construction in accordance with claim 8, wherein said bottom rabbet (27) extends transversely to both the elongate apertures (15) and an extrusion direction of the panels (1).

10. A facade construction in accordance with claim 8, wherein the facade panels are ceramic.

11. A curtained, back-ventilated facade construction comprising a plurality of extrusion molded facade panels (1) arranged as front and rear panel frameworks (12,13) which are connected to one another by webs (14) and provided with elongate apertures (15) arranged substantially parallel to the webs (14) between the same, said facade construction provided with a top rabbet (16) at an upper end of a respective facade panel (1), wherein height (17) of the top rabbet (30) formed by an extension of the front panel framework (32,33) is smaller than or equal to height of a joint (28) visible from a rear side of the facade construction and defined between adjacent rear panels (1).

12. A facade construction in accordance with claim 11, wherein said top rabbet (30) extends transversely to both the elongate apertures (15) and an extrusion direction of the panels (1).

13. A facade construction in accordance with claim 11, wherein the facade panels are ceramic.

14. A curtained, back-ventilated facade construction comprising a plurality of extrusion molded facade panels (11) arranged as front and rear panel frameworks (12, 13) which are connected to one another by webs (14) and provided with elongate apertures (15) substantially parallel to the webs (14) between the same, said facade construction provided with a bottom rabbet (35) at a lower end of a respective facade panel (1), wherein height of the bottom rabbet (35) formed by an extension of the rear panel framework (36) is smaller than or equal to height of a joint visible from a front side (32, 33) of the facade construction and defined between adjacent front panels (1), and the bottom rabbet extends transversely to the elongate apertures.

15. A facade construction in accordance with claim 14, wherein said bottom rabbet (35) extends transversely to an extrusion direction of the panels (1).

16. A facade construction in accordance with claim 14, wherein the facade panels are ceramic.

* * * * *